United States Patent [19]

Doutre

[11] 4,241,474

[45] Dec. 30, 1980

[54] MOBILE FLAX DECORTICATOR

[75] Inventor: Joseph A. M. Doutre, Beauharnois, Canada

[73] Assignee: Domtar Inc., Montreal, Canada

[21] Appl. No.: 7,492

[22] Filed: Jan. 29, 1979

[51] Int. Cl.[3] ..... D01B 1/24

[52] U.S. Cl. ..... 19/26; 19/33

[58] Field of Search ..... 19/5 R, 5 A, 6, 9, 26, 19/33, 200, 205, 83, 90; 56/16.5; 241/296

[56] References Cited

U.S. PATENT DOCUMENTS

| | | | |
|---|---|---|---|
| 2,983,965 | 5/1961 | Schneider | 19/33 |
| 3,064,315 | 11/1962 | Schneider | 19/33 |
| 3,872,545 | 3/1975 | Altosaar | 19/26 |

*Primary Examiner*—Louis Rimrodt

*Attorney, Agent, or Firm*—C. A. Rowley

[57] ABSTRACT

A mobile flax decorticator wherein the flax is collected in the field by passing the decorticator through the field and picking up the flax from swaths and the like, the flax straw is then decorticated by passing first through a shredder and then a decorticator, the decorticated flax is directed into a pneumatic cyclone wherein the bast fibres are separated from the dross with the bast fibres exiting through the apex outlet of the cyclone and entering into a suitable packaging equipment such as a baler.

8 Claims, 6 Drawing Figures

MOBILE FLAX DECORTICATOR

Present invention is related to a flax decorticator more specifically the present invention relates to a mobile decorticator for collecting flax straw in the field decorticating the flax straw, separating bast and dross fibres, leaving the dross fibres in the field and packaging the bast fibres.

DESCRIPTION OF THE PRIOR ART

Various equipment has been proposed for use in decorticating flax and also has been proposed to utilize equipment in the field. Such equipment is shown for example in U.S. Pat. Nos. 2,983,965 and 3,064,315 issued May 15, 1961 and Nov. 20, 1962 respectively to Schneider Jr. The equipment disclosed in these two patents uses a hammer mill and carries the flax through the hammer mill in an air stream with the dross fibres being driven through the cage of the hammer mill so that the hammer mill performs two functions, namely, that of decortication and of separation. While this equipment was designed to be mobile, it was found to be too heavy to be utilized by passing through the field to harvest the flax straw and the flax straw had to be transported to a fixed location for processing. This device also required considerable horse power and could not be driven, for example, from a power take-off on a conventional tractor.

Subsequently a more efficient decorticator was described in U.S. Pat. No. 3,872,545 issued Mar. 25, 1975 to Altassar. This device uses a disc rotating in close proximity to housing with the disc and the housing being provided with co-operating pins mounted at specific angles so that the flax could be decorticated using relatively little power. However, this device while being effective as a decorticator, provided no separation for the bast and dross after decortication.

BRIEF DESCRIPTION OF THE PRESENT INVENTION

It is the object of the present invention to provide a mobile light-weight, low horse power, flax decorticator and adapted to travel through the field and collect the flax, decorticate same separate the bast from the dross and package the bast in suitable form for transport.

Broadly the present invention relates to mobile flax processing equipment comprising a mobile frame on which said equipment is mounted, means to collect flax and direct same to a shredder, said shredder, shredding and accelerating said flax and directing it through a conduit means, a disc type flax decorticator having a rotating disc enclosed within a housing and having a working space formed between said disc and an opposing wall of said housing, means to rotate said disc, working elements projecting into said working space from said disc and said opposing wall, said elements comprising pins sloped radially and tangentially thereby to facilitate travel of the flax through said working space while decorticating said flax straw into bast fibres and dross, impellers on said disc, a separator, a second conduit means, said impellers drawing air through said first conduit and aiding in transporting said flax straw to said decorticator and after decorticating along said second conduit means to said separator, said separator separating said decorticated straw into a bast rich fraction and a dross fraction said means for packaging said bast rich fraction for transport.

BRIEF DESCRIPTION OF THE DRAWINGS

Further features, objects and advantages will be evident from the following detailed description of the preferred embodiments of the present invention taken in conjunction with the accompanying drawings in which.

DESCRIPTION OF THE PREFERRED EMBODIMENTS

Figure 1:
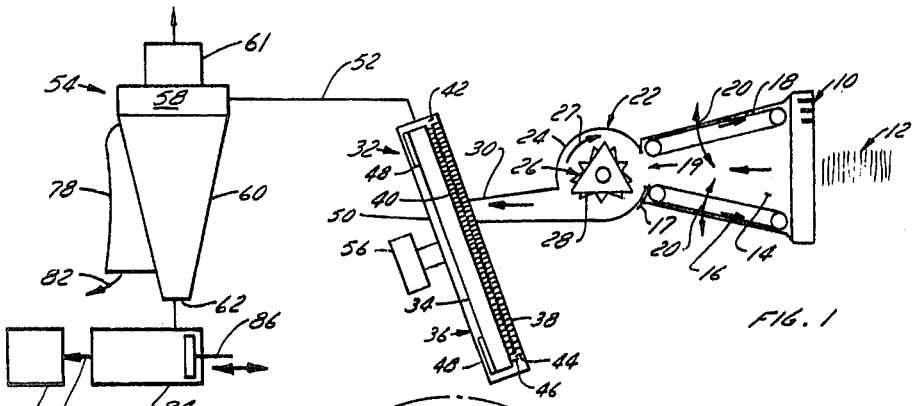
FIG. 1 is a schematic illustration of the various operations of the present invention.

Like reference numerals indicate like parts throughout the various views.

Figure 2:
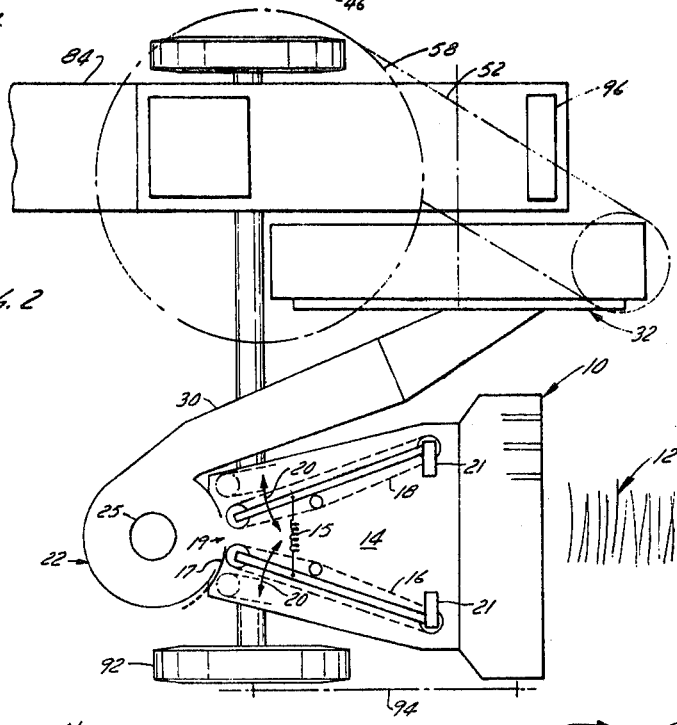
FIG. 2 is a schematic plan view of the invention with parts omitted for clarity.

FIGS. 1 and 2 schematically illustrate the operation and arrangement of equipment comprising the present invention. The equipment includes a pick-up device 10 which may be a rake type pick-up conventionally used to pick-up swaths of grain in the field. Normally the flax will have been harvested and the flax straw left in rows or swaths in the field. In any event, the pick-up 10 collects flax straw from the row or swaths of flax straw schematically illustrated 12 and passes it onto the ramp 14 which has a pair of substantially vertical belt conveyers 16 and 18 positioned one on each side thereof. Preferably each of these conveyers is pivotedably mounted adjacent the pick-up 10 and has its end remote from the pick-up 10 movable toward and away from and biased toward the other of said conveyers via spring means schematically indicated at 15 (FIG. 2). In the illustrated arrangement the arrows 20 indicates such movement for the conveyers 16 and 18. This movement meters the flow of straw and ensures that the flax straw is gripped and fed by the belt conveyers 16 and 18 into a shredder generally indicated at 22. The conveyers 16 and 18 are driven by suitable hydraulic motors indicated at 21 (FIG. 2).

The conveyer 16 on the side of the shredder 22 leading in the direction of rotation is provided with a deflection plate 17 which moves with the free end of the conveyer to open and close the mouth 19 the housing of the shredder so that the material as it is being shredded is retained within the shredder and is directed to the inlet conduit.

The shredder 22 is provided by a housing 24 enclosing a rotating drum 26 formed by a plurality of substantially triangular discs or plates 28 stacked one on top of the other with the points of the triangles slightly offset one relative to the other. The drum 26 is driven by a suitable hydraulic motor 25 in the direction of the arrow 27. The flax straw enters the shredder 22, is engaged by the points of the plates 28 and is projected along an infeed conduit 30 toward the decorticator 32. The shredder 22 functions to preliminarily breakdown or cut the flax straw into short lengths and to accelerate and project the flax into and along the conduit 30 towards the decorticator 32.

Figure 3:
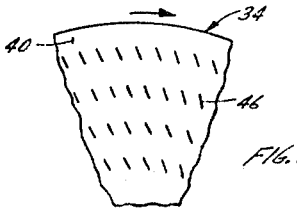
FIG. 3 is a partial plan view of the decorticator disc illustrating the angles of the pins.
Figure 6:
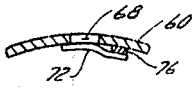
FIG. 6 is a section along line 6—6 of FIG. 5 showing the shape of the screening bars.

The decorticator 32 is substantially the same as the decorticator described in the said U.S. Pat. No. 3,872,545 to Altaasar and is composed of a disc 34 rotating within a housing 36. One wall or face 38 of the housing 36 cooperates with the front face 40 of the disc to form between them a working space 42. The faces 38 and 40 are provided with working elements 44 and 46 respectively in the form of pins arranged in consecutive rows in the inter-meshing, over-lapping relationship so that the pins of 46 on the disc do not interfere with the pins 44 on the housing and vice versa as the disc is rotated relative to the housing. The pins 46 on the rotating disc slope away from the face 40 rearwardly relative to the direction of rotation of the disc (see FIG. 3), and the pins 46 on the housing slope away from the face 38 forwardly in the direction of rotation, while the pins 44 and 46 all slope radially outward relative to the axis of rotation of the disc. Thus the pins 44 and 46 all slope radially outward and tangentially to facilitate the passage of flax through the decorticator as described more fully in the said U.S. Pat. No. 3,872,545.

It will be noted that the conduit 30 is directed at an angle to the working face 40 and offset from the axis of rotation of the disc 34 so that the flax entering the working space 42 does so at an angle directing the material with a momentum in the direction radially outward of the disc. To facilitate this radial movement impellers or paddles such as those indicated at 48 are mounted on the rear face of the disc and functioned to draw air in through the duct 30 and through the back wall 50 of the decorticator to help transport the flax toward the decorticator 32 through the inlet duct or conduit 30 and from the decorticator 32, through the exhaust conduit 52 and into the pneumatic cyclone separator 54. The disc 34 is driven by a suitable motor schematically illustrated at 56.

The cyclone separator 54 has a cylindrical section 58 and a conical section 60 and the conduit 52 provides a tangential inlet adjacent the top or base of the cylindrical section 58. Suitable outlets including a base outlet 61 for air and an apex outlet 62 for the bast fibre are provided at opposite longitudinal ends of the cyclone separator 54.

Figure 4:
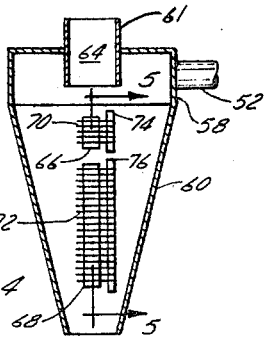
FIG. 4 is a longitudinal section through a separator in the form of a pneumatic cyclone used in the present invention.

The cyclone separator 54 is not a conventional cyclone separator although it has many features in common with a conventional cyclone separator. As shown in FIG. 4 the cyclone separator 54 at its base outlet 61 and a vortex finder 64 which projects into the cyclone separator almost to the bottom of the cylindrical section 58. However, the conical section 60 is provided with, in the illustrated arrangement, a pair of substantially axially extending slots 66 and 68 which are covered with screening rod means generally indicated at 70 and 72 respectively. Screening means are mounted from bars 74 and 76 trailing openings 66 and 68 respectively in the direction of movement of the material.

The screening means 70 and 72 are each composed of a plurality of round or cylindrical rods about $\frac{1}{4}''$ diameter on $\frac{1}{2}''$ centres and each of the bars 74 and 76 has a thickness (projecting in from the conical wall 60) of approximately $\frac{1}{8}''$.

In operation the material first traverses the bars 74 and 76 which tend to deflect material away from the wall then across the openings 66 and 68. The rods 70 and 72 extend substantially in the direction of movement of the material and thus do not obstruct movement of the material around the cyclone, however they tend to block the opening to bast fibre while permitting the escape of dross material through the openings 66 and 68.

Figure 5:
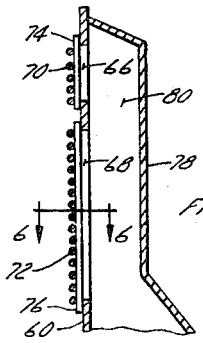
FIG. 5 is a section along the line 5—5 of FIG. 4 with the curviture of the conical section eliminated.

The openings 66 and 68 are enclosed on the outer surface of the cyclone by a housing generally indicated at 78 (see FIG. 5) that provides a passage 80 for the dross material escaping through the outlets 66 and 68 and directs this material down and out of the unit as indicated by the arrow 82 in FIG. 4. Thus the dross material leaves the equipment in operation and is thus spread around the field due to the movement of the equipment around the field to pick up the straw and thereby facilitates its functioning as fertilizer.

The preferred arrangement of the present invention as above described incorporates the separator device as a part of a pneumatic cyclone but this is not essential. Other conventional screening means may be used. For example, air may be separated from the decorticated flax using a conventional cyclone and the dross material separated from the bast using a conventional screening means adapted to make the separation. However, such arrangements generally significantly increase the weight of the unit and could result in significantly impairing mobility of the equipment.

Bast material leaves the cyclone 54 through the apex outlet 62 and is introduced into a suitable baling mechanism generally indicated at 84. The baler is provided with the conventional reciprocating plunger mechanism 86 to form the bale which is ejected as indicated by the arrow 88 to provide bale 90 that may be transported to the site where it is finally used.

The feed rate of the baler is correlated with the production or feed of bast from the cyclone which will normally require reducing of the speed of the baler piston so that the number of strokes of the piston is fewer than a conventional baler. The flax is not a fodder crop similar to for example alfalfa, and it has been found that the speed of the baler can be slowed down to about 6 or 8 strokes as compared with the strokes of the conventional baler.

The baler 84 preferably will be a wire type baler rather than a conventional cord type baler as it has been found that with the cord type baler difficulty is encountered in producing a tight bale since the spring-back of the bast fibres is not equivalent to the spring-back normally encountered in conventional hay or other fodder material normally baled with the equipment.

Each of the elements such as the shredder 22, disc 34 and the conveyers 16 and 18 may be driven by any suitable means such as hydraulic motors. Power requirements of the equipment are relatively small and therefore the power source may be the same as the equipment used to pull the device through the field i.e. the power take-off from a suitable tractor. In the arrangement shown the power take off from the tractor is used to power the hydraulic pump schematically indicated at 96 in FIG. 2 which in turn drives the various hydraulic motors. The baler is also driven from the power take-off while the pick-up 10 is driven by rotation of the wheel 92 by ground engagement and through the drive chain 94 (see FIG. 2).

The bast rich fraction that is baled generally contains about 60% bast 40 dross as is normally best suited for pulping.

Modification can be made without departing from the spirit of the invention as defined in the appended claims.

I claim:

1. A mobile flax processing machine comprising, a mobile frame mounting said machine, means to collect flax straw, a shredder, means for directing collected flax to said shredder, means to rotate said shredder, a first conduit means directing flax from said shredder to a disc type flax decorticator having a rotating disc enclosed within a housing, means to rotate said disc, said flax decorticator having a working space formed between a working face on said disc and a working face in said housing, working elements projecting into said working space from said working faces said elements comprising pins sloped radially outward and tangentially so as to facilitate travel of flax straw through said working space while decorticating said flax straw into bast fibre and dross, impellers on said disc, a separator, a second conduit means, said impellers drawing air through said first conduit means and aiding transport of flax straw to said decorticator and from said decorticator through said second conduit means to said separator, said separator being a cyclone separator having a pair of axial outlets and and at least one opening through an outer surface thereof means to retain said bast fibre by inhibiting said bast fibre passing through said opening while permitting dross to pass therethrough, said separator rejecting a bast rich fraction through one of said axial outlets, and means for packaging said bast rich faction for transport.

2. A machine as defined in claim 1 wherein said means for packaging comprises a baler for baling said bast fibre.

3. A machine is defined in Claim 1 wherein said separator comprises a conical section wherein said axial outlets are an apex and a base outlet, and wherein said at least one opening is in said conical section, and wherein said means retaining said bast rich faction comprises screening means extending over said opening to contain bast fibre while permitting dross to pass therethrough.

4. A machine as defined in claim 3 wherein said screening means comprises a plurality of rods extending over said opening; said bars extending substantially in the direction of movement of bast fibre and dross in said cyclone means.

5. A machine as defined in claim 4 wherein said screening means further comprises a bar trailing said opening in the direction of movement of said bast fibre and dross, said rods being mounted on said bar.

6. A machine as defined in claim 5 wherein said means for packaging comprises a baler.

7. A machine as defined in claim 6 wherein said baler is a wire type baler.

8. A machine as defined in claims 1, 2 or 3 wherein said collecting means includes a ramp, a pair of conveyers on opposite sides of said ramp, the ends of said conveyers adjacent said shredder being moveably mounted and biased toward each other.

* * * * *